US009745535B2

(12) United States Patent
Sawyer et al.

(10) Patent No.: US 9,745,535 B2
(45) **Date of Patent: *Aug. 29, 2017**

(54) ARTICLES HAVING LOW COEFFICIENTS OF FRICTION, METHODS OF MAKING THE SAME, AND METHODS OF USE

(71) Applicant: University of Florida Research Foundation, Inc., Gainesville, FL (US)

(72) Inventors: Wallace Gregory Sawyer, Gainesville, FL (US); Jennifer Vail, Gainesville, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/403,821

(22) Filed: Jan. 11, 2017

(65) Prior Publication Data

US 2017/0121631 A1 May 4, 2017

Related U.S. Application Data

(60) Continuation of application No. 15/151,621, filed on May 11, 2016, now Pat. No. 9,580,667, which is a continuation of application No. 14/462,787, filed on Aug. 19, 2014, now Pat. No. 9,365,791, which is a division of application No. 13/319,274, filed as (Continued)

(51) Int. Cl.

| | |
|---|---|
| ***F16C 33/20*** | (2006.01) |
| ***C10M 169/00*** | (2006.01) |
| ***B32B 5/16*** | (2006.01) |
| ***B32B 17/08*** | (2006.01) |
| ***C10M 169/04*** | (2006.01) |

(Continued)

(52) U.S. Cl.

CPC ..... *C10M 169/041* (2013.01); *C10M 107/32* (2013.01); *C10M 147/02* (2013.01); *C10M 2209/1013* (2013.01); *C10M 2213/02* (2013.01); *C10N 2220/08* (2013.01); *C10N 2220/086* (2013.01); *C10N 2250/08* (2013.01)

(58) Field of Classification Search

CPC ..... C10N 2240/02; C10M 2213/062; C01P 2004/64; C08J 5/18

USPC ..... 508/106, 182; 428/327, 838; 977/773

See application file for complete search history.

(56) References Cited

U.S. PATENT DOCUMENTS

| | | | |
|---|---|---|---|
| 4,483,900 | A | 11/1984 | Goldfarb |
| 4,559,249 | A | 12/1985 | Arigaya et al. |

(Continued)

FOREIGN PATENT DOCUMENTS

| | | |
|---|---|---|
| JP | 06228330 | 8/1994 |
| JP | 2009013351 | 1/2009 |
| WO | 2008029510 | 3/2008 |

OTHER PUBLICATIONS

Reinicke et al., "On the Tribological Behaviour of Selected, Injection Moulded Thermoplastic Composites," Composites Part A: Applied Science and Manufacturing, vol. 29, Issue 7, 1998, pp. 763-771.*

(Continued)

*Primary Examiner* — Vishal Vasisth

(74) *Attorney, Agent, or Firm* — Thomas | Horstemeyer, LLP

(57) ABSTRACT

Briefly described, embodiments of this disclosure include articles and methods of making articles.

11 Claims, 4 Drawing Sheets

Cross-sectional view

Top view, a-a of FIG. 1

Related U.S. Application Data application No. PCT/US2010/034466 on May 12, 2010, now Pat. No. 8,846,586.

(60) Provisional application No. 61/178,522, filed on May 15, 2009.

(51) Int. Cl.
*C10M 147/02* (2006.01)
*C10M 107/32* (2006.01)

(56) References Cited

U.S. PATENT DOCUMENTS

| | | | | |
|---|---|---|---|---|
| 7,182,518 | B2 | 2/2007 | Lee et al. | |
| 2005/0042976 | A1 | 2/2005 | Ronay | |
| 2006/0030681 | A1* | 2/2006 | Sawyer | C08J 3/005 525/471 |

OTHER PUBLICATIONS

Khedkar et al., "Sliding Wear Behavior of PTFE Composites," Wear, 252, pp. 361-369, 2002.*

The International Search Report and Written Opinion dated Feb. 24, 2011.

Reinicke, et al., "On the Tribological Behaviour of Selected, Injection Moulded Thermoplastic Composites," Composites Part A: Applied Science and Manufacturing, vol. 29, Issue 7, 1998, pp. 763-771.

Sawyer, et al., "A Study on the Friction and Wear Behavior of PTFE Filled with Alumina Nanoparticles," Wear, vol. 254, Issues 5-6, Mar. 2003, pp. 573-580.

* cited by examiner

Cross-sectional view

Top view, a-a of FIG. 1

ARTICLES HAVING LOW COEFFICIENTS OF FRICTION, METHODS OF MAKING THE SAME, AND METHODS OF USE

CROSS-REFERENCE TO RELATED APPLICATION

This application is a continuation of U.S. Utility application entitled "ARTICLES HAVING LOW COEFFICIENTS OF FRICTION, METHODS OF MAKING THE SAME, AND METHODS OF USE", having Ser. No. 15/151,621, filed on May 11, 2016, which is a continuation of U.S. Utility application entitled "ARTICLES HAVING LOW COEFFICIENTS OF FRICTION, METHODS OF MAKING THE SAME, AND METHODS OF USE", having Ser. No. 14/462,787 (now U.S. Pat. No. 9,365,791), filed on Aug. 19, 2014, which is a divisional application of U.S. Utility application entitled "ARTICLES HAVING LOW COEFFICIENTS OF FRICTION, METHODS OF MAKING THE SAME, AND METHODS OF USE" having Ser. No. 13/319,274 (now U.S. Pat. No. 8,846,586), filed on Nov. 7, 2011; which claims priority to and the benefit of PCT Patent Application entitled "ARTICLES HAVING LOW COEFFICIENTS OF FRICTION, METHODS OF MAKING THE SAME, AND METHODS OF USE", having serial number PCT/US2010/034466, filed May 12, 2010, where the PCT claims priority to and U.S. Provisional Application entitled "ARTICLES HAVING LOW COEFFICIENTS OF FRICTION, METHODS OF MAKING THE SAME, AND METHODS OF USE," having Ser. No. 61/178,522, filed on May 15, 2009, all of which are entirely incorporated herein by reference.

FEDERAL SPONSORSHIP

This invention was made with Government support under Contract/Grant No. 00049344, awarded by the Air Force Office of Scientific Research and Multi-University Research Incentive. The Government has certain rights in this invention.

BACKGROUND

Solid lubrication offers many benefits over conventional oil-based hydrodynamic and boundary lubrication. Solid lubrication systems are generally more compact and less costly than oil lubricated systems since pumps, lines, filters and reservoirs are usually required in oil lubricated systems. Greases can contaminate the product of the system being lubricated, making it undesirable for food processing and both grease and oil outgas in vacuum precluding their use in space applications. Thus, there is a need in the art for solid lubricants.

SUMMARY

The present disclosure provides articles, methods of making articles, methods of using articles, and the like.

An embodiment of article, among others, includes a polymer matrix having a plurality of solid lubricant structures, wherein the solid lubricant structures are chosen from: a filament, a fiber, a yarn, and a combination thereof.

An embodiment of article, among others, includes a polymer matrix having a plurality of solid lubricant structures having an aspect ratio of about 5:1 or more, wherein a portion of the plurality of the solid lubricant structures in the polymer have an alignment direction that is not parallel a plane that is transverse with the sliding surface of the article.

An embodiment of article, among others, includes a polymer matrix having a plurality of solid lubricant structures having an aspect ratio of about 5:1 or more, wherein each solid lubricant structure has a central axis down the longest dimension of the solid lubricant structure, wherein at the edge of a side of the article where the solid lubricant structure is adapted to slide along a sliding surface, the angle between the central axis of a plurality of the solid lubricant structures and a plane that is transverse with the sliding surface of the article is about 5° degrees or more.

BRIEF DESCRIPTION OF THE DRAWINGS

The disclosure can be better understood with reference to the following drawings. The components in the drawings are not necessarily to scale, emphasis instead being placed upon clearly illustrating the principles of the present disclosure.

DETAILED DESCRIPTION

Figure 1A:
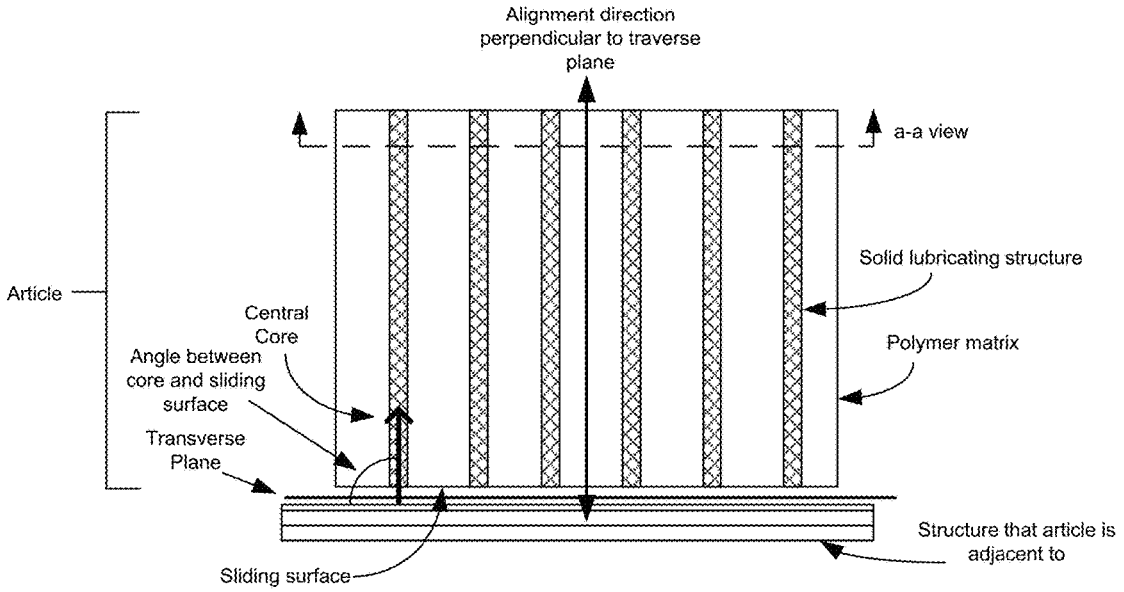
FIG. 1A illustrates a cross-sectional view of an embodiment of an article.

Before the present disclosure is described in greater detail, it is to be understood that this disclosure is not limited to particular embodiments described, as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed. Terms defined in references that are incorporated by reference do not alter definitions of terms defined in the present disclosure or should such terms be used to define terms in the present disclosure they should only be used in a manner that is inconsistent with the present disclosure.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of chemistry, fiber, fabrics, textiles, and the like, which are within the skill of the art. Such techniques are explained fully in the literature.

The following examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is in atmosphere. Standard temperature and pressure are defined as 25° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Discussion

Embodiments of the present disclosure provide for articles, methods for making articles, and methods of using articles. Embodiments of the present disclosure relate to articles having superior tribological properties. In particular, embodiments of the present disclosure have a low coefficient of friction and very low wear. In addition, embodiments of the present disclosure provide for articles that are resistant to chemicals, have a high strength, are biocompatible, are water resistant, and/or have high thermal resistance (e.g., withstand extreme temperatures).

Embodiments of the article include a polymer matrix having a plurality of solid lubricant structures. The solid lubricant structures are disposed in the polymer matrix. In an embodiment, the solid lubricant structures have an aspect ratio of about 5:1 or more. In other embodiments of the article, the solid lubricant structure can have an aspect ratio of about 10:1 or more, about 50:1 or more, or about 100:1 or more. In an embodiment, the article can be designed to have a coefficient of friction of about 0.3 to 0.05. In other embodiments, the article can have a coefficient of friction of about 0.25 to 0.05, about 0.2 to 0.05, about 0.15 to 0.10, or about 0.15 to 0.05.

Figure 1B:
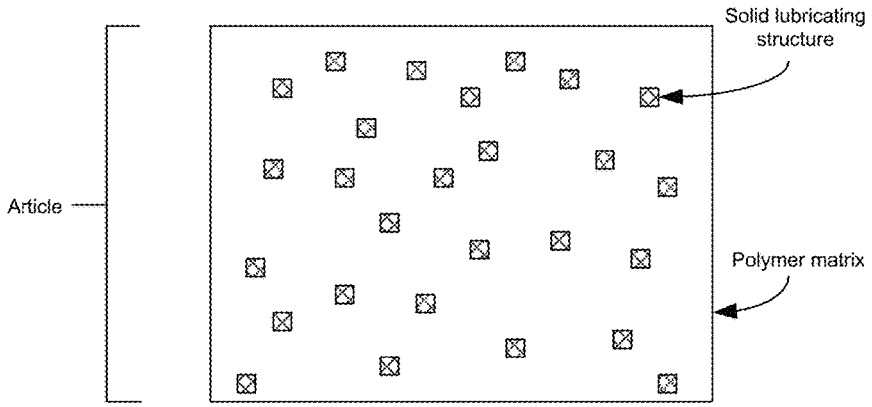
FIG. 1B illustrates a top-view of the article shown in FIG. 1A.

FIG. 1A illustrates a cross-sectional view of an embodiment of an article. As shown in FIG. 1A, the article includes a polymer matrix having a plurality of solid lubricant structures disposed in the polymer matrix. FIG. 1B illustrates a top-view of the article shown in FIG. 1A, which illustrates the solid lubricating structures disposed in the polymer matrix.

In an embodiment, a portion of the plurality of the solid lubricant structures in the polymer has an alignment direction (e.g., the entire length of the solid lubricant structure or the portion of the solid lubricant structure that is intended to at some point be exposed at the sliding surface) that is not parallel a plane that is transverse with the sliding surface of the article (e.g., See FIG. 1A). In an embodiment, the alignment direction is considered from the perspective of the entire solid lubricant structure (e.g., for example, the alignment direction can takes into account the entire length of the solid lubricant structure or the portion that will at some point be exposed at the sliding surface). In other words, the alignment direction of the solid lubricant structure is not parallel with the sliding surface, since if the alignment direction is parallel, the solid lubricant structure could be pulled out from the article. In another embodiment, a portion of the plurality of the solid lubricant structures has an alignment direction that is substantially parallel (e.g., about 80% or about 90%, depending on the structure), but not parallel, a plane that is transverse with the sliding surface of the article. In another embodiment, a portion of the plurality of the solid lubricant structures has an alignment direction that is substantially (e.g., ±5%, ±10%, ±20%, ±30%, or ±40%, depending on the structure) perpendicular or perpendicular a plane that is transverse with the sliding surface of the article.

In an embodiment, each solid lubricant structure has a central axis, or central core, down the longest dimension of the solid lubricant structure. At the edge of the article where the solid lubricant structure is adjacent the sliding surface, the angle between the central axis of the solid lubricant structure and a plane that is transverse with the sliding surface of the article is about 5° or more. In other embodiments, the angle (e.g., at the edge and/or within the article) between the central axis of the solid lubricant structure (or a plurality of solid lubricant structures) and a plane that is transverse with the sliding surface of the article is about 10° or more (up to about 90°), about 15° or more, about 20° or more, about 30° or more, or about 40° or more (wherein here "or more" has an upper limit of about 90°). In an embodiment of the article, a portion of the solid lubricant structures in the article is at one or more the angle noted above, which a portion may not be at these angles.

It should be noted that the in some embodiments a portion or a small length of the solid lubricant structure may be parallel the plane that is transverse with the sliding surface of the article, but the portion is small (e.g., less than a few percent (e.g., about 2-5%) relative to the length of the solid lubricant structure) and/or small (e.g., less than 2× the diameter of the solid lubricant structure) relative to the diameter of the solid lubricant structure. It will be understood by one of skill in the art that in some instances the solid lubricant structure (e.g., a fiber) may have curves and in some instances the portions of the solid lubricant structure having the curve may be parallel the plane that is transverse with the sliding surface of the article. However, in these instances, the solid lubricant structures can still function as intended.

In each of these embodiments, "a portion" refers to an amount of the solid lubricant structures so that the article has a coefficient of friction as described herein (e.g., about 0.3 to 0.05). In an embodiment, the portion can be about 20% or more of the solid lubricant structure in the article. In other embodiments, the portion can be about 30% or more, about 40% or more, about 50% or more, or about 60% or more, of the solid lubricant structure in the article. In an embodiment, the portion can be about 20 to 100% of the solid lubricant structure in the article. In other embodiments, the portion can be about 30 to 100%, about 40 to 100%, about 50 to 100%, or about 60% or 100%, of the solid lubricant structure in the article.

Figure 2A:
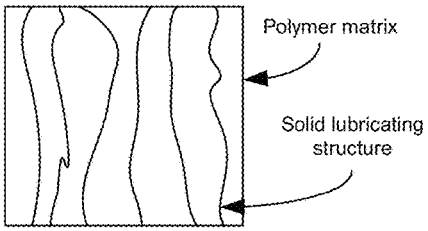
FIGS. 2A to 2G illustrate cross-sectional views of an embodiment of an article.

As noted in the figures, in an embodiment, the alignment of the solid lubricant structures can be any one of the following: a portion of the solid lubricant structures are substantially (e.g., about 90%, about 95%, about 97%, about 98%, about 99%, or about 100%, depending on the structure) parallel one another (FIG. 1A), a portion of the solid lubricant structures form a crisscross pattern (FIG. 2C or 2D), a portion of the solid lubricant structures form a wave pattern (e.g., curved as opposed to a straight line) (FIG. 2A), or combinations thereof.

In an embodiment, the articles can be used in low friction applications. The types of articles can vary greatly and include articles where reduced friction is advantageous. The articles can have a variety of shapes and cross sections (FIG. 2A-2G)). In an embodiment, the shape of the article can be a simple geometrical shape (e.g., spherical (FIGS. 2E and 2F), polygonal, and the like) or a complex geometrical shape (e.g., irregular shapes). In general, the article can have a cross-sectional shape including, but not limited to, a polygon, a curved cross-section, and combinations thereof.

Embodiments of the articles can be used in many structures, parts, and components in the in the automotive, industrial, aerospace industries, and sporting equipment industries, to name but a few industries where articles having superior tribology characteristics are advantageous. The article can be used in many different applications including, but not limited to, mechanical parts (e.g., bearing, joins pistons, etc), structures having load bearing surfaces, sporting equipment, machine parts and equipment, and the like.

Figure 2B:
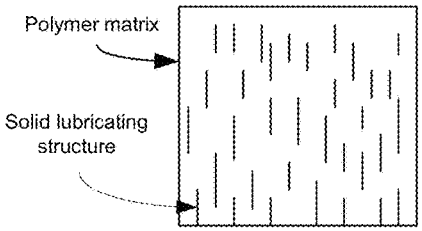
Figure 2C:
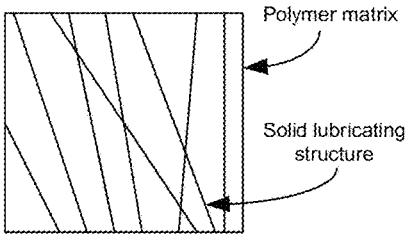
Figure 2D:
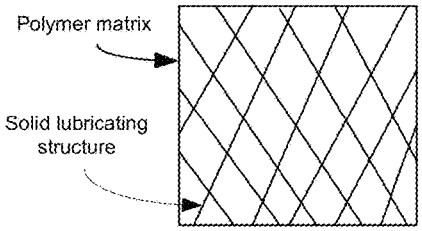
Figure 2E:
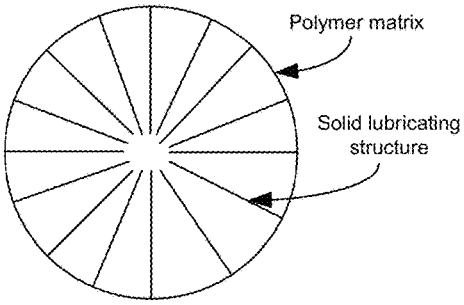
Figure 2F:
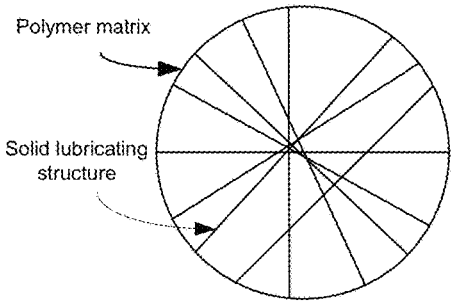
Figure 2G:
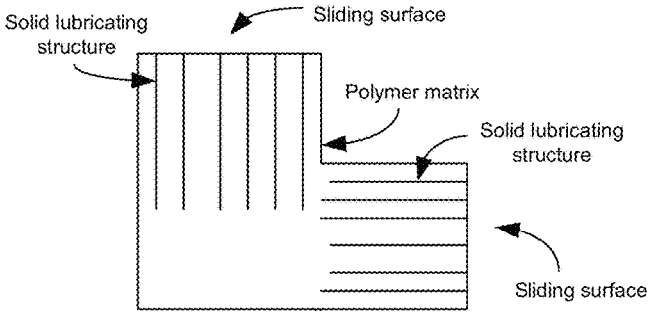

In general, an embodiment of the article can have one or more sliding surfaces (FIG. 2G). In this regard, the article can have one or more groups of solid lubricant structures, where each group can have an alignment direction (as described herein) positioned relative to a plane that is transverse with a sliding surface of the article. Thus, articles can be designed to accommodate articles having multiple sliding surfaces.

It should also be noted that the coefficient of friction and wear characteristics of articles of the present disclosure can be designed for a particular application. Thus, embodiments of the present disclosure can provide articles that can satisfy many different requirements for different industries and for particular components.

Embodiments of the polymer matrix can be made of polymers that have one or more of the following characteristics: inert, corrosion resistant, high melting point, high strength, or a combination thereof. In particular, embodiments of the polymer matrix can be made of polymers such as, but not limited to, a polyetheretherketone (PEEK), a polyimide (PI), polyamide (PA), poly amide imide (PAI), a polyphenylene sulfide (PPS), polysulphone (PSU), polyether sulphone (PES), precursors thereof, derivatives thereof, homopolymers thereof, monomers thereof, copolymers thereof, terpolymers thereof, or combinations thereof. In an embodiment, the polymer is PEEK.

In an embodiment, the polymer matrix is about 50 to 95 volume % of the article. In another embodiment, the polymer matrix is about 75 to 90 volume % of the article. In another embodiment, the polymer matrix is about 70 to 85 volume % of the article.

Embodiments of the solid lubricant structure can be a filament, a fiber (e.g., including two or more filaments), or a yarn (e.g., including two or more fibers). In an embodiment, the article can include any combination of a filament, a fiber, or a yarn. In an embodiment, the filament can have a diameter of about 100 to 300 nm. In an embodiment, the fiber can include 2, 3, 4, 5, or more filaments. In an embodiment, the yarn can include 2, 3, 4, 5, or more fibers. In an embodiment, the solid lubricant structure is not a particle.

The solid lubricant structures can extend the length of the article and/or a portion of the article (See FIG. 1A and FIG. 2B). In an embodiment, the article can be designed so that a portion of the solid lubricant structures are adjacent (e.g., in contact with the sliding surface of the substrate) the sliding surface to achieve the coefficient of friction desired for the article. As a result, some embodiments contemplate an article having a portion or all of the solid lubricating structures having a length that is not the same as the article, but the article has the desired coefficient of friction.

In an embodiment, the solid lubricant structures can be disposed or positioned in the article in a pattern. In an embodiment, the pattern can be selected based on the sliding surface, the desired coefficient of friction, and the like. In another embodiment, the solid lubricant structures can be disposed or positioned in the article randomly.

Embodiments of the solid lubricant structures can be made of a fluoropolymer. The term "fluoropolymer" can include a polymer having at least one fluorine-containing monomer and can be a homopolymer, copolymer, and terpolymer. Embodiments of the fluoropolymer can include polymers such as, but not limited to, polytetrafluoroethylene (PTFE), fluorinated ethylene-propylene (FEP), perfluoroalkoxy polymer resin (PFA), polychlorotrifluoroethylene (PCTFE), polytrifluoroethylene, polyvinylidene fluoride (PVDF), polyvinyl fluoride (PVF), tetrafluoroethylene-ethylene copolymer resin (ETFE), fluoroethylene propylene ether resin (EPE), copolymers of each, terpolymers of each, and the like. In an embodiment, the fluoropolymer can be PTFE, PFA, FEP, copolymers of each, terpolymers of each, or a combination thereof, where PTFE, PFA, and FEP refer to a chemical that can be used to form Teflon®. In an embodiment, the fluoropolymer is PTFE.

In an embodiment, the solid lubricant structure(s) can be about 5 to 40 volume % of the article. In another embodiment, the solid lubricant structure can be about 10 to 30 volume % of the article. In another embodiment, the solid lubricant structure can be about 15 to 25 volume % of the article.

Embodiments of the articles can be made by disposing the solid lubricant structure in a solution of polymer matrix and allowing the polymer matrix to solidify around the solid lubricant structure. In an embodiment, the polymer matrix powder is laid out in a press (e.g., a cigar press), with solid lubricant then laid on top. These layers are repeated until the desired amount has been reached. This mixture is then transferred to a molding chamber where it is heated to the matrix material's melt point, held for a period of time, and then cooled to ambient. Other methods of making the article are contemplated within the scope of the present disclosure.

EXAMPLES

Now having described the embodiments of the present disclosure, in general, the following Examples describe some additional embodiments of the present disclosure. While embodiments of present disclosure are described in connection with the following examples and the corresponding text and figures, there is no intent to limit embodiments of the present disclosure to this description. On the contrary, the intent is to cover all alternatives, modifications, and equivalents included within the spirit and scope of embodiments of the present disclosure.

Example 1

Methods and Materials:

The solid lubricant, PTFE, is commercially available and can be ordered through a vendor (Plastomertech). The polymer, poly(ether ether) keytone, matrix is obtained in a similar manner (Victrex). Four types of articles were constructed, each with different forms of PTFE: powder PTFE, randomly oriented expanded PTFE filaments, aligned PTFE filaments, and aligned PTFE threads. The article having the powder PTFE was constructed by combining PEEK powders with the appropriate weight percents of PTFE powder. These powders were then ultrasonically mixed, pressed to 40 Mpa and heated in a molding chamber to about 362° Celsius. The article having the randomly oriented expanded PTFE filaments was constructed by randomly placing the filaments within layers of PEEK powder. The article having the aligned PTFE filaments was constructed by laying the filaments in the same orientation in a cigar type press. PEEK powder was placed between layers of the aligned filaments until the unit was full. Once the cigar press is full of the composite, it is pressed to 40 MPA. The article having the aligned PTFE threads was constructed in the same manner as the aligned filaments article. Once the article is made, it is heated to the matrix melting point and cooled. Subsequently, the article is machined into the final shape.

Discussion

Figure 3:
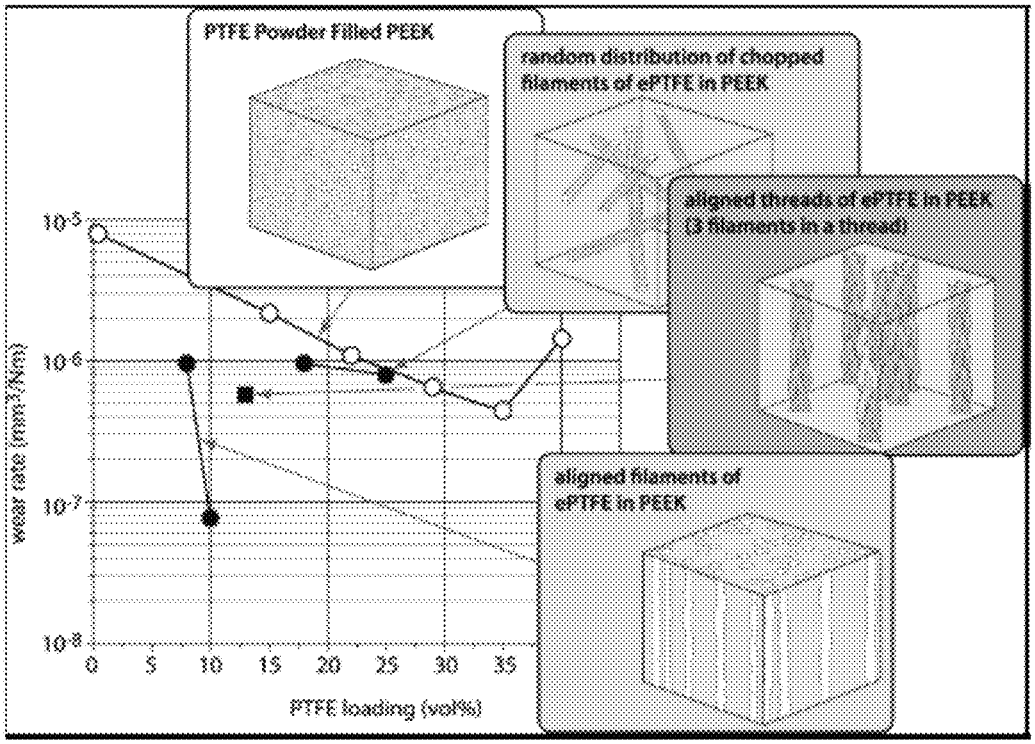
FIG. 3 is a graph that illustrates various embodiments that describe the influence that polytetrafluoroethylene (PTFE) (e.g., amount and orientation) has as a filler material on the wear rate of the composites.

FIG. 3 is a graph that illustrates various embodiments that describe the influence that PTFE (e.g., amount and orientation) has as a filler material on the wear rate of the composites. Different forms of PTFE are shown: powder PTFE, randomly oriented expanded PTFE filaments, aligned ePTFE filaments and aligned ePTFE threads. FIG. 3 shows that by using aligned expanded PTFE filaments, one can achieve lower wear rates than other filler types and do so with much less volume of the filler. Thus, embodiments of the present disclosure are advantageous.

Figure 4:
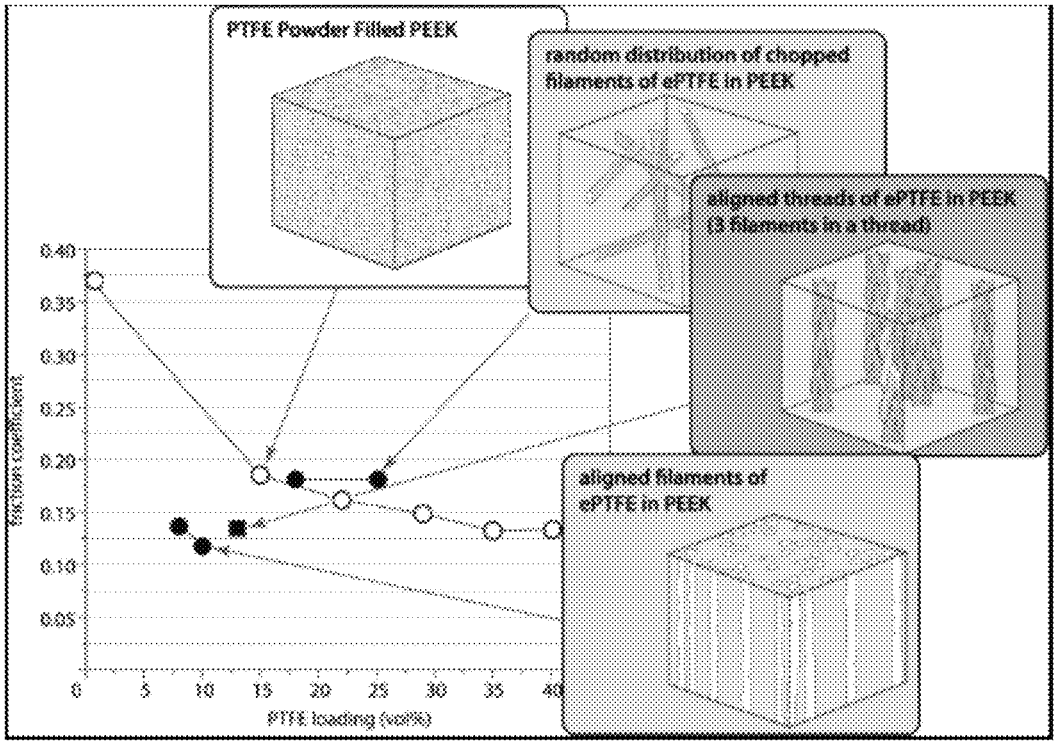
FIG. 4 is a graph that illustrates various embodiments that describe the influence of various PTFE fillers in the polyetheretherketone (PEEK) matrix on the friction coefficient.

FIG. 4 is a graph that illustrates various embodiments that describe the influence of various PTFE fillers in the PEEK matrix on the friction coefficient. Different forms of PTFE are shown: powder PTFE, randomly oriented expanded PTFE filaments, aligned ePTFE filaments and aligned ePTFE threads. At high loadings of PTFE powder one can achieve the friction coefficients close, but not equal to, the friction coefficients seen in the aligned filaments. Thus, embodiments of the present disclosure are advantageous.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, the term "about" can include traditional rounding according to significant figures of the numerical value. In addition, the phrase "about 'x' to 'y'" includes "about 'x' to about 'y'".

Many variations and modifications may be made to the above-described embodiments. All such modifications and variations are intended to be included herein within the scope of this disclosure and protected by the following claims.

The invention claimed is:

1. An article, comprising:

a polymer matrix having a plurality of solid lubricant structures, wherein the solid lubricant structure are chosen from: a filament, a fiber, a yarn, and a combination thereof;

wherein a portion of the plurality of the solid lubricant structures in the polymer have an alignment direction that is not parallel to a plane that is transverse with the sliding surface of the article; and wherein the solid lubricant structures have a diameter of about 100 nm to about 300 nm.

2. The article of claim 1, wherein the plurality of solid lubricant structures having an aspect ratio of about 5:1 or more.

3. The article of claim 1, wherein at the edge of a side of the article where the solid lubricant structure is adapted to slide along a sliding surface, an angle between a central axis of a plurality of the solid lubricant structures and a plane that is transverse with the sliding surface of the article is about 5° or more.

4. The article of claim 1, wherein the article has a coefficient of friction of about 0.15 to 0.05.

5. The article of claim 1, wherein the plurality of solid lubricant structures having an aspect ratio of about 10:1 or more.

6. The article of claim 1, wherein the solid lubricant structure is about 5% to about 40% of the article and wherein the polymer matrix is about 50% to about 95% of the article.

7. The article of claim 1, wherein the article has a cross-sectional shape selected from a group consisting of: a polygon, a curved cross-section, and a combination thereof.

8. The article of claim 1, wherein a portion of the solid lubricant structures are substantially parallel to one another.

9. The article of claim 1, wherein a portion of the solid lubricant structures form a crisscross pattern in the polymer matrix.

10. The article of claim 1, wherein one or more of the solid lubricant structures form a wave pattern in the polymer matrix.

11. The article of claim 1, wherein the polymer is chosen from: a polyetheretherketone (PEEK), a polyimide (PI), polyamide (PA), poly amide imide (PAI), a polyphenylene sulfide (PPS), polysulphone (PSU), polyether sulphone (PES), a precursor thereof, a derivative thereof, a terpolymer thereof, and a combination thereof.

* * * * *